US007118143B2

(12) United States Patent
L'Heureux et al.

(10) Patent No.: US 7,118,143 B2
(45) Date of Patent: Oct. 10, 2006

(54) TEMPORARY DOOR LATCH

(75) Inventors: Marc J. L'Heureux, Victor, MT (US); Gary Hanson, Corvallis, MT (US); Paul O. Beck, Hamilton, MT (US)

(73) Assignee: Ideal Door Components Incorporated, West Linn, OR (US)

( * ) Notice: Subject to any disclaimer, the term of this patent is extended or adjusted under 35 U.S.C. 154(b) by 115 days.

(21) Appl. No.: 10/821,513

(22) Filed: Apr. 9, 2004

(65) Prior Publication Data

US 2004/0201228 A1 Oct. 14, 2004

Related U.S. Application Data

(60) Provisional application No. 60/462,355, filed on Apr. 10, 2003.

(51) Int. Cl.
*E05C 1/00* (2006.01)

(52) U.S. Cl. ..... 292/175; 49/380

(58) Field of Classification Search ..... 292/175, 292/DIG. 30, DIG. 38; 49/380
See application file for complete search history.

(56) References Cited

U.S. PATENT DOCUMENTS

| | | | | |
|---|---|---|---|---|
| 121,060 | A | 11/1871 | Mutimer | |
| 939,004 | A | 11/1909 | Gill | |
| 1,988,925 | A | 1/1935 | Thomson | |
| 2,706,837 | A | 4/1955 | Jackson | |
| 2,720,308 | A | 10/1955 | Howell, Jr. | |
| 2,728,956 | A | 1/1956 | Jackson | |
| 2,730,773 | A | 1/1956 | Logue | |
| 2,927,352 | A | 3/1960 | Chenoweth | |
| 3,584,416 | A | 6/1971 | Baumgartel | |
| 3,593,458 | A | 7/1971 | Wahlfeld | |
| 4,001,972 | A | 1/1977 | Hurwitz | |
| 4,109,948 | A * | 8/1978 | Potter et al. | 292/169.15 |
| 4,151,681 | A | 5/1979 | Roberts | |
| 4,483,101 | A | 11/1984 | Berzina | |
| 4,718,195 | A | 1/1988 | Ortega | |
| 4,739,561 | A | 4/1988 | Mills | |
| 4,848,813 | A * | 7/1989 | Fildan | 292/167 |
| 4,854,618 | A | 8/1989 | Webster | |
| 4,876,866 | A | 10/1989 | Fleming et al. | |
| 4,884,687 | A | 12/1989 | Steves | |
| D319,007 | S | 8/1991 | Rogers et al. | |
| 5,159,782 | A * | 11/1992 | Sales | 49/380 |
| 5,209,017 | A | 5/1993 | Ridge | |
| 6,170,198 | B1 * | 1/2001 | Staples et al. | 49/380 |

FOREIGN PATENT DOCUMENTS

| | | | |
|---|---|---|---|
| DE | 27 18 562 | A1 | 11/1978 |

* cited by examiner

*Primary Examiner*—Gary Estremsky
(74) *Attorney, Agent, or Firm*—Schwabe Williamson & Wyatt

(57) ABSTRACT

A temporary door latch for a door having a face bore and an edge bore where the edge bore extends from the face bore to a lateral edge of the door. The edge bore is disposed in substantial alignment with a strike bore of a door jam. The temporary door latch includes a longitudinal bolt portion that is dimensioned to extend through the edge bore and into the strike bore when the bolt portion is in a latching position. An actuation member is disposed adjacent one distal end of the bolt portion and is selectively operable to move the bolt portion between the latching position and a non-latching position. A flexible neck portion is also provided to connect the actuation member to the bolt portion, the neck portion selectively permitting the actuation member to bend in a substantially perpendicular direction to a longitudinal axis of the bolt portion.

9 Claims, 9 Drawing Sheets

TEMPORARY DOOR LATCH

CROSS REFERENCE TO RELATED APPLICATIONS

This application is entitled to the benefit of U.S. Provisional Application No. 60/462,355, filed Apr. 10, 2003, which is hereby incorporated by reference in its entirety.

FIELD OF THE INVENTION

This invention relates, in general, to a temporary door latch, and deals more particular with a temporary door latch assembly that releasably holds a pre-hung door within a door jam, as well as being selectively operable to enable the door to move between a latched position and a non-latched position.

BACKGROUND OF THE INVENTION

Pre-hung doors can be either interior doors or exterior doors and, as the name implies, are manufactured to be already mounted, or hung, within the border of a door jam. The use of pre-hung doors effectively eliminates the need to fashion a door jam on the work site, including routing out locations on the door or door jam to accommodate the hinge hardware and arranging the door for proper swinging. Thus, pre-hung doors greatly reduce the time and labor necessary to install doors.

Door jams typically comprise two vertical side jams, a hinge jam and a strike jam, and a header fitted across the top, between the side jams. A sill may also be fitted beneath the bottom of the door, between the side jams. Pre-hung doors are typically prepped for the installation of lock sets, via the milling of a face bore and an edge bore in the body of the door, but are not actually fitted with the knobs, striker plates, latch and other hardware.

Pre-hung doors are thus attached to the hinge jam via known hinge hardware, but are capable of freely swinging in and out of the door jam due to the lack of any restraining latch hardware. As will be appreciated, freely-swinging doors pose a problem during shipping, as well as possibly causing injury to the door itself. Moreover, it is also important to prevent the door from rubbing against the inside of the strike jam, which may cause damage to the door jam as well as the door. It is therefore imperative to at least temporarily arrest the freely-swinging nature of pre-hung doors.

There are several known devices which effectively arrest the freely-swinging motion of a pre-hung door during transportation and the like. One method relies upon actually nailing the strike jam to the door itself. Another method utilizes plastic straps or inserts which are then stapled or nailed to the door jam and door. All of these methods obviously injure the integrity of the door and door jam, and thus repairs must be made prior to use of the pre-hung door.

In addition to the concerns expressed above, pre-hung doors, once transported to a work site and set in place, must also be able to be selectively actuated in order to provide ingress and egress for workers, inspectors or the like. That is, once the known arresting devices are removed from installed pre-hung doors in order to permit swinging access therethrough, there still must be a way to selectively retain the doors in a closed position in order to prevent the entry of unwanted materials or animals, as well as to prevent heat loss when construction occurs during periods of cold temperatures.

Traditionally, pieces of scrap wood, nails, sticks or the like are inserted into the face and edge bores of the door to extend into the strike bore of the strike jam, thereby preventing the door from swinging open. In addition to the possibility of damaging the door or door jam, these items frequently fall out or break and are quickly rendered ineffective.

With the forgoing problems and concerns in mind, it is the general object of the present invention to provide a temporary door latch assembly that releasably holds a pre-hung door within a door jam during transport, while also being selectively operable to enable the door to move between a latched position and a non-latched position.

SUMMARY OF THE INVENTION

It is one aspect of the present invention to provide a temporary door latch.

It is another aspect of the present invention to provide a temporary door latch for use with pre-hung doors.

It is another aspect of the present invention to provide a temporary door latch for use with pre-hung doors that effectively holds the door in a closed position during transportation.

It is another aspect of the present invention to provide a temporary door latch for use with pre-hung doors that will assist in the installation of the pre-hung door.

It is another aspect of the present invention to provide a temporary door latch for use with pre-hung doors that may also provide for the latching and unlatching of the door after the initial installation of the door.

It is another aspect of the present invention to provide a temporary door latch for use with pre-hung doors that reduces the frictional impediment to latching or unlatching the door.

It is another aspect of the present invention to provide a temporary door latch for use with pre-hung doors that, after installation, may be selectively fixed in the latched position from the inside of a building construction.

It is another aspect of the present invention to provide a temporary door latch for use with pre-hung doors that is equipped with a collar portion which effectively eliminates structural damage to the door when in use.

It is another aspect of the present invention to provide a temporary door latch for use with pre-hung doors that prevents the loss of heat or the introduction of water, dirt or other debris.

In accordance therefore with one embodiment of the present invention, a temporary door latch for a door having a face bore and an edge bore where the edge bore extends from the face bore to a lateral edge of the door. The edge bore is disposed in substantial alignment with a strike bore of a door jam. The temporary door latch includes a longitudinal bolt portion that is dimensioned to extend through the edge bore and into the strike bore when the bolt portion is in a latching position. An actuation member is disposed adjacent one distal end of the bolt portion and is selectively operable to move the bolt portion between the latching position and a non-latching position. A flexible neck portion is also provided to connect the actuation member to the bolt portion, the neck portion selectively permitting the actuation member to bend in a substantially perpendicular direction to a longitudinal axis of the bolt portion.

These and other aspects and objectives of the present invention, and their preferred embodiments, shall become clear by consideration of the specification, claims and drawings taken as a whole.

DETAILED DESCRIPTION OF THE PREFERRED EMBODIMENT

Figure 1:
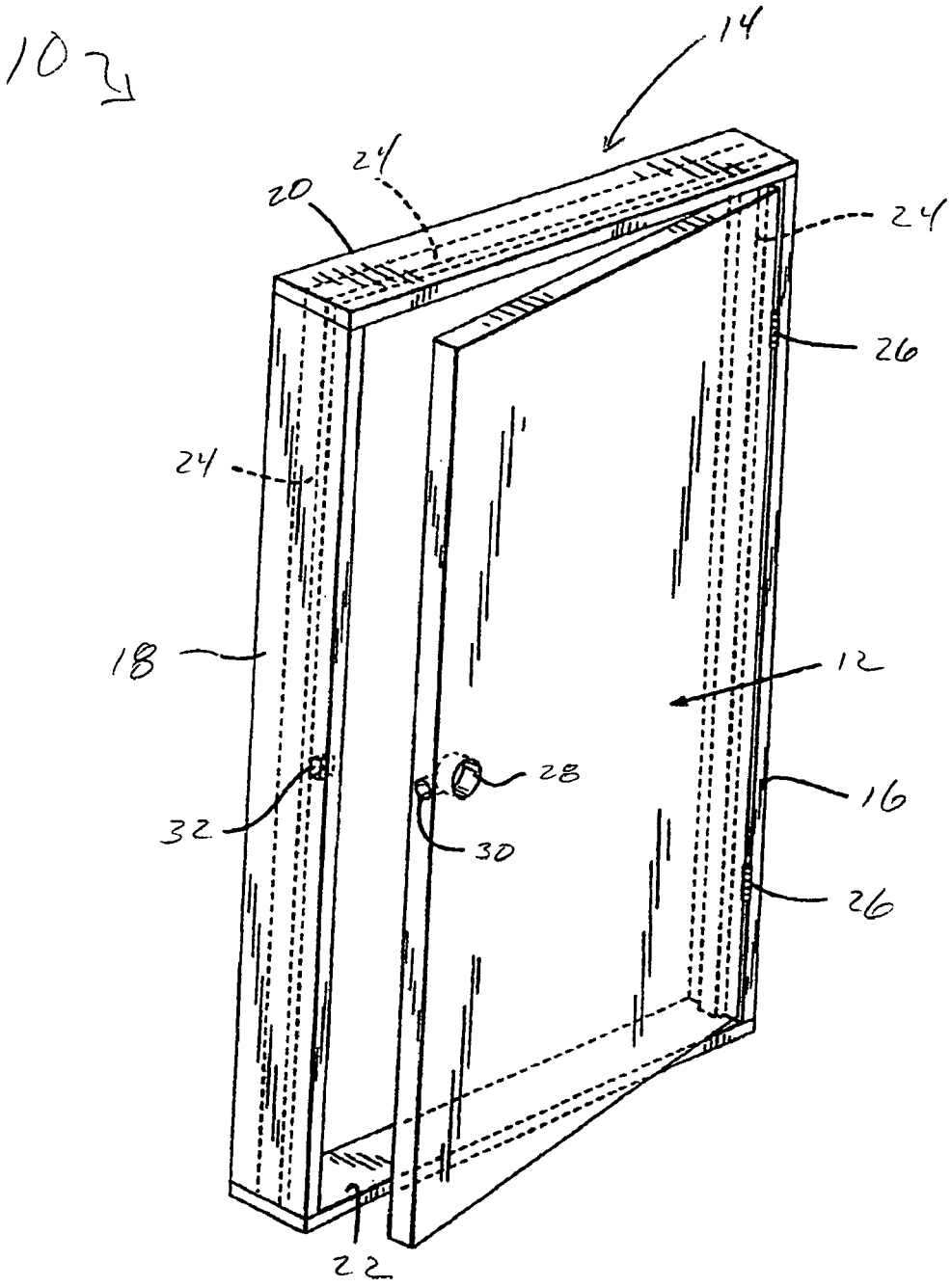
FIGURE 1 PRIOR ART
FIG. 1 illustrates a known pre-hung door assembly for use with a temporary door latch of the present invention.

FIG. 1 illustrates a known pre-hung door assembly 10 for use with a temporary door latch of the present invention. As shown in FIG. 1, the pre-hung door assembly 10 includes a door 12 and a door jam 14. The door jam 14 itself includes a hinge jam 16, a strike jam 18, a header 20 and a sill member 22 disposed beneath the door 12. Moreover, the door jam 14 further includes elongated door stop moldings 24 that extend substantially around the/inner periphery of the door jam 18 to provide an abutting surface against which the door 12 may abut when the door 12 is in its closed position.

The door 12 is swingingly mounted within the door jam 14 via a plurality of hinge mechanisms 26. As is typical, a face bore 28 and an edge bore 30 are milled or otherwise formed in the door 12. When the door 12 is in its closed position, the edge bore 30 is in substantial alignment with a strike bore 32 formed in the strike jam 18 of the door jam 14. The temporary door latch of the present invention will now be explained in connection with the pre-hung door assembly 10 shown in FIG. 1.

Figure 2:
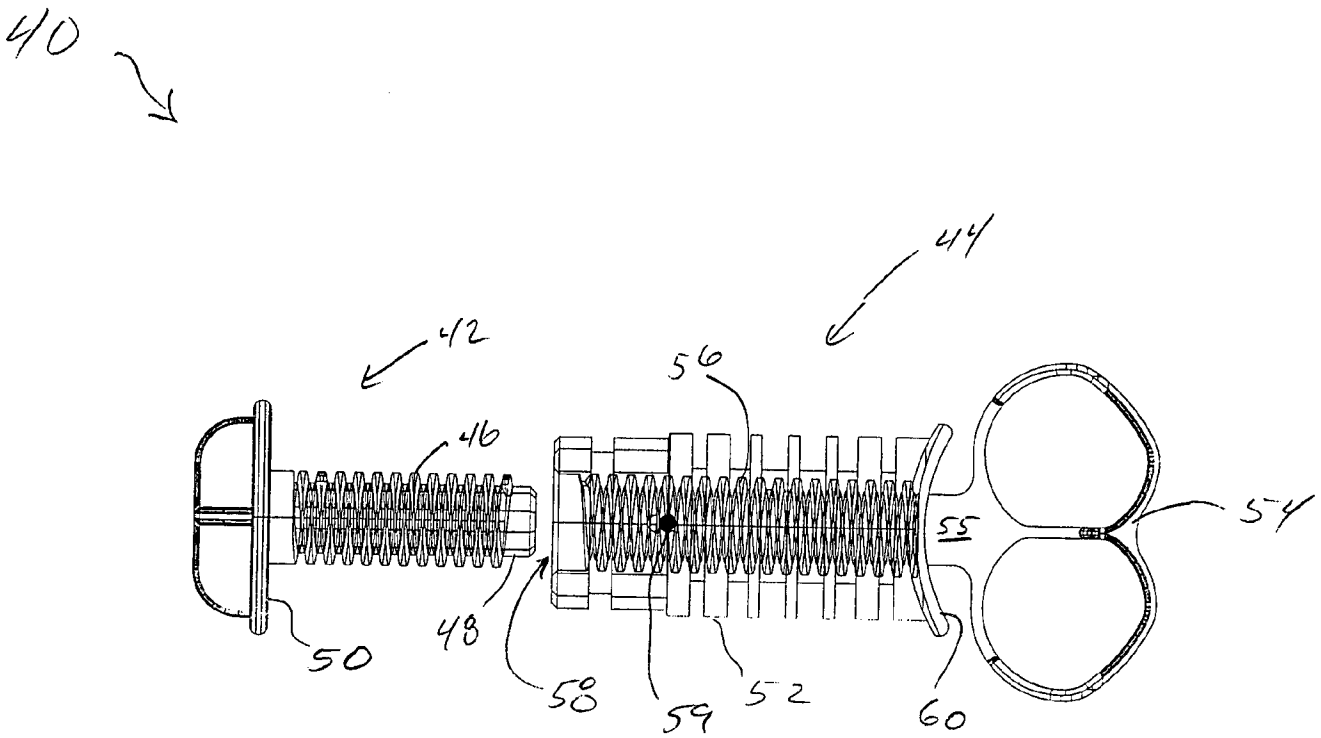
FIG. 2 illustrates a partial cross-sectional side view of a temporary door latch, in accordance with one embodiment of the present invention.

FIG. 2 illustrates a partial cross-sectional side view of a temporary door latch 40, in accordance with one embodiment of the present invention. As shown in FIG. 2, the temporary door latch 40 includes a threaded engagement member 42 and a manually operable locking member 44. The threaded engagement member is preferably formed as a threaded bolt, or the like, and includes a plurality of double-start threads 46 formed about the outer periphery of a shank portion 48. The threaded engagement member 40 further includes a radially extending flange portion 50 against which the outer surface of the strike jam 18 will selectively abut, as will be described in more detail later.

As also shown in FIG. 2, the locking member 44 defines a bolt portion 52 and an actuation portion 54. The actuation portion 54 is connected to the bolt portion 52 via a neck portion 55, the purpose and operation of which will be explained shortly in conjunction with FIG. 3B. The bolt portion 52 includes an arresting aperture 59 and a plurality of matching threads 56 inscribed about a longitudinally extending inner bore 58, the matching threads 56 being provided for nesting accommodation of the threads 46 defined on the threaded engagement member 40.

It will be readily appreciated that while double-start threads 46 have been described in connection with the threaded engagement portion 40, the present invention is not limited in this regard as alternative thread patterns and configurations may be utilized without departing from the broader aspects of the present invention. Indeed, the threads 46 and the inner bore 58 may have any manner of matching threads, lands or other key-pattern configurations provided that the engagement portion 42 may be selectively engaged with the locking member 44.

Returning to FIG. 2, the locking member 44 further defines an arcuate collar 60 formed adjacent the actuation portion 54. The collar 60 is preferably shaped to substantially conform to the inner peripheral surface of the face bore 28 when the locking member 44 is in its locking position, as will be described in more detail with reference to FIG. 3.

Figure 3:
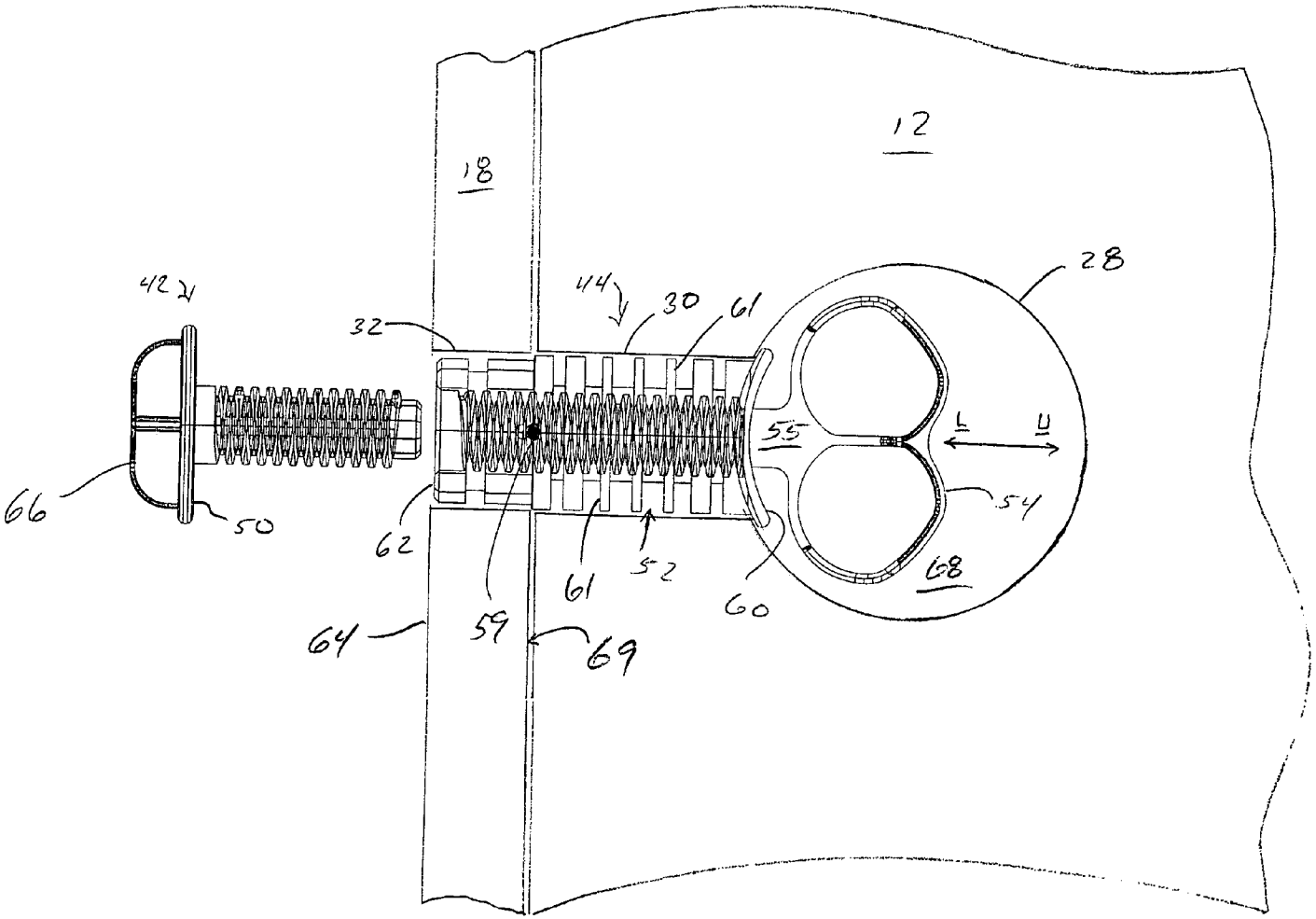
FIG. 3 illustrates the temporary door latch as it is utilized to maintain the door in its closed position with respect to the strike jam.

FIG. 3 illustrates the application of the temporary door latch 40 as it is utilized to maintain the door 12 in its closed position with respect to the strike jam 18. As shown in FIG. 3, the bolt portion 52 of the locking member 44 has been inserted through the face bore 28 and into the edge bore 30, thereby extending into the strike bore 32. When in this position, it will be readily appreciated that the bolt portion 52 effectively prevents the door 12 from swinging free of the strike jam 18 and thus maintains the door 12 in its closed position.

It will also be readily appreciated that the dimensions of the bolt portion 52 are chosen so as to slidably fit within the known and standardized dimensions of the edge bore 30 and the strike bore 32. Moreover, the present invention contemplates that the outer dimensions and geometric configuration of the bolt portion 52 may be of any size or shape provided that it substantially fills, at least in one radial direction, the diameter of the edge bore 30 and strike bore 32, thus preventing excessive movement of the door 12 with respect to the strike jam 18.

It is therefore an important aspect of the present invention that the bolt portion 52 include a series of outwardly extending ribs 61 in order to slidably abut the inner surface of the edge bore 30, while also not inhibiting the insertion and removal of the bolt portion 52 from the edge bore 30. That is, by forming a plurality of ribs 61 on the bolt portion 52, the contact surface of the bolt portion 52 against the inner surface of the edge bore 30 is significantly reduced. Thus, any friction between the inner surface of the edge bore 30 and the exterior contact surface of the bolt portion 52 may be correspondingly reduced. Such a configuration is especially helpful when the door 12 is fabricated from a wood material which may experience humidity or contact with rain during transportation, and which may swell by some amount. It should be noted that known retaining plugs typically utilize a bolt portion which includes, at least in part, a longitudinally extending and continuous contact surface to abut the inner surface of the edge bore 32. Thus, known retaining plug devices suffer from difficulties in insertion and extraction owing to excessive friction between these surfaces, especially when the pre-hung door assembly experiences humidity or water contact.

Returning now to FIG. 3, once the locking member 44 has been fully inserted through the edge bore 30 and into the strike bore 32, the collar 60 will substantially conform to the inner surface of the face bore 28. That is, the longitudinal length of the locking member 44 is also designed in accordance with the known and standardized longitudinal dimensions of the edge bore 30 so as to ensure that the seating of the collar 60 against the inner surface of the face bore 28 indicates and corresponds to the full insertion of the locking member 44. Moreover, the collar 60 also prevents the locking member 44 from being too greatly inserted into the edge bore 30, the occurrence of which would cause the distal end 62 of the locking member 44 to undesirably stick outwardly from the exterior plane 64 of the strike jam 18.

After insertion of the locking member 44, the threaded engagement member 40 will be axially and threadedly engaged with the locking member 44 until the flange 50 abuts the exterior plane of the strike jam 18. Manipulation of the engagement member 42 via an outwardly extending turning vane 66 will subsequently cause the engagement member 42 to draw the collar 60 towards the flange 50 until the door 12 and the strike jam 18 are securely held in a substantially fixed relationship with one another.

It is thus another important aspect of the present invention that the temporary door latch 40 may be utilized to retain the door 12 in its closed position during transportation without incurring any structural damage to either the door 12 or the door jam 14. Still yet another important aspect of the present invention may also be recognized with reference to FIG. 3A, as explained hereinafter.

Figure 3A:
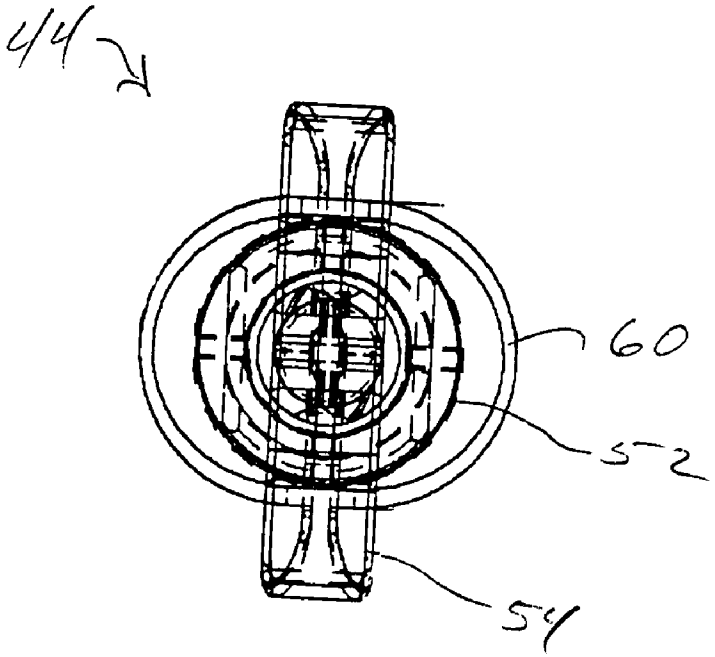
FIG. 3A is a partial cross-sectional end view of the temporary door latch shown in FIGS. 2 and 3.

FIG. 3A is a partial cross-sectional end view of the locking member 44, and illustrates the dimensional relationship between the collar 60 and the outer diameter of the bolt portion 52. As will be appreciated with reference to FIGS. 2, 3 and 3A in combination, the collar 60 is shown as having a roughly oval design and a substantially arcuate cross-section, so as to comfortably seat against the inner peripheral surface of the face bore 28. Moreover, the collar 60 is designed so as to extend in all radial directions beyond the outer dimensions, or diameter, of the bolt portion 52 in its entirety.

It is therefore an important aspect of the present invention that the force exerted by the collar 60 and incident upon the inner periphery of the face bore 28 is transferred in a 360° manner. That is, in stark contrast with known door latch devices that typically employ planar collar structures which do not extend, in their entireties and in every radial dimension, beyond the outer diameter of their respective bolt portions, the force exerted by the collar 60 is not concentrated on a relatively small area of the inner peripheral surface of the face bore 28 when the temporary door latch 40 is tightened in place via the operation of the threaded engagement member 42. It will therefore be readily appreciated that the collar 60 of the present invention effectively permits a secure and tight mating between the threaded engagement member 42 and the locking member 44, while effectively eliminating the occurrence of structural damage to the inner peripheral surface of the face bore 28.

Once the pre-hung door assembly 10 has reached the work site, the engagement member 42 will be removed from threaded engagement with the locking member 44 in order to permit the initial installation of the pre-hung door assembly 10. Thereafter, it often becomes difficult to assuredly retain the door 12 in its closed position, when desired or necessary. The adaptation of the actuation portion 54 of the temporary door latch 40 addresses this concern.

As shown in FIG. 3, and subsequent to the engagement member 42 being removed, an operator may easily utilize the actuation portion 54 to shift the entire locking member 44 in an axial direction to either engage or disengage the locking member 44 from disposition within the strike bore 32. That is, the actuation portion 54 extends into the zone 68 defined by the face bore 28 and may be shifted in an unlatching direction U, or in a latching direction L, as shown in FIG. 3.

It is therefore another important aspect of the present invention that the temporary door latch 40 includes the manually operable actuation portion 54 for selectively latching or unlatching the door 12. Moreover, by extending outwardly into the zone 68 defined by the face bore 28, the actuation portion 54 provides an ease of operation heretofore unknown in the art. In a preferred embodiment of the present invention, the actuation portion 54 is shaped to conform to an operator's fingers, although the present invention equally contemplates that the actuation portion 54 may take any geometric shape provided that it extends far enough into the zone 68 to provide easy access for operation.

As further shown in FIG. 3, the actuation member 54 extends into the face bore 28 and is advantageously spaced from the inner periphery of the face bore 28 when the collar 60 substantially abuts this inner periphery, thus providing ready access to an operator wishing to move the locking member 44 between its latching and non-latching positions.

Figures 3B, 4:
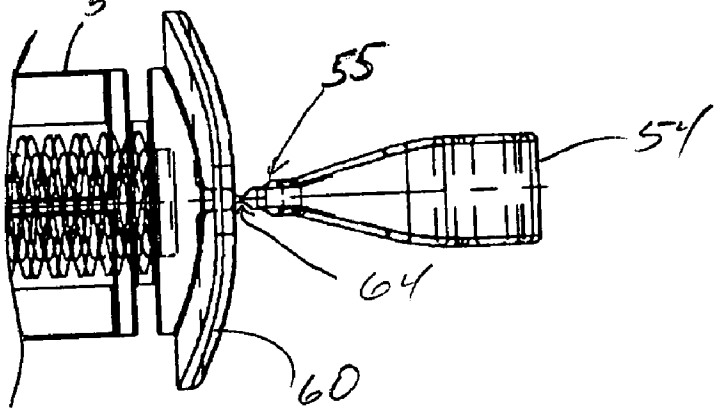
FIG. 3B is a partial cross-sectional side view of the temporary door latch shown in FIGS. 2 and 3, and rotated 90°.
FIG. 4 illustrates a locking member for the temporary door latch of FIGS. 2 and 3, in accordance with another embodiment of the present invention.

Turning now to FIG. 3B, a partial cross-sectional side view of the temporary door latch shown in FIGS. 2 and 3, and rotated 90°, is illustrated. In a preferred embodiment of the present invention, the actuator portion 54 is preferably formed from a highly elastic and pliable material, such as but not limited to a plastic, rubber or other polymer material. As is most clearly shown in FIGS. 2, 3 and 3B in combination, the neck portion 55 connects the actuation portion 54 to the bolt portion 52 and is formed as a wide, yet relatively thin, connector. Indeed, as depicted in FIG. 3B, the neck portion 55 defines an hour-glass cross-section, having a flex portion 64 at the approximately midpoint thereof.

It is therefore another important aspect of the present invention that the relative thinness of the neck portion 55, coupled with the narrowed mid-point of the flex portion 64, enables the actuator portion 54 to bend in a substantially perpendicular direction to the longitudinal axis of the bolt portion 52, thus permitting insertion of the locking member 44 into the face bore 28 and through the edge bore 30 and strike bore 32. That is, given the dimensional constraints of typically sized face bores in the art, and the corresponding length required by the bolt portion 52 to extend through the edge bore 30 and into the strike bore 32, the inclusion of the actuator portion 54 would greatly impair, if not prohibit, the insertion of the locking member 44 if the constituent components of the locking member were all rigid or semi-rigid.

The neck portion 55 of present invention therefore permits the actuator portion 54 to deform about flex portion 64, thus temporarily reducing the overall length of the locking member 44 and enabling its insertion into the face bore 28. As will be appreciated, once the locking member 44 is insertion into the face bore 28, and at least partially inserted through the edge bore 30, the resilient nature of the flex portion 64 and the neck 55 will cause the actuator portion 54 to resume its operable position, shown in FIGS. 2–3B.

The present invention also provides a user of the temporary door latch 40 the opportunity to selectively lock the locking member 44 in a latching position. As shown in FIG.

3, when the locking member 44 is substantially inserted into the edge bore 30 and the strike bore 32, the arresting aperture 59 is substantially aligned with the gap 69 formed between the edge of the door 12 and the strike jam 18.

The arresting portion 59 is formed so as to extend partially into the body of the bolt portion 52, and is dimensioned accept the introduction of a small gauge nail, or the like. In the preferred embodiment of the present invention, the arresting aperture 59 is sized to accept an 8 penny nail. Insertion of the nail through the gap 69 and into the arresting aperture 59 will effectively prevent the locking member 44 from moving in a longitudinal direction. That is, the insertion of the nail into the arresting aperture 59 will ensure that the stationary, latching position of the locking member 44 is maintained, even in the event that operation of the actuator portion 54 is attempted.

It is therefore yet another important aspect of the present invention that the temporary door latch 40 not only provides for the selective movement of the locking member 44 between a latching position and a non-latching position, but that once in a latching position, an operator may selectively engage the arresting portion 59 to securely fix the locking member 44 in its latching position. It will be readily appreciated that the locking member 44 would be inserted into the edge bore 30 such that the arresting aperture 59 faces the inside of the building construction, thus allowing the selective operation of the arresting aperture 59 from one side of the door 12 only. Thus, the temporary door latch 40 of the present invention also satisfies safety and security concerns.

Figure 5:
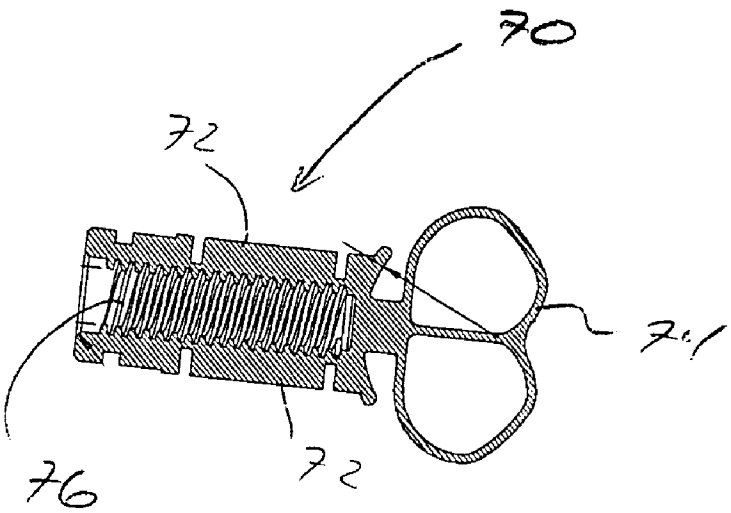
FIG. 5 illustrates a cross-sectional view of the locking member shown in FIG. 4.
Figure 4:
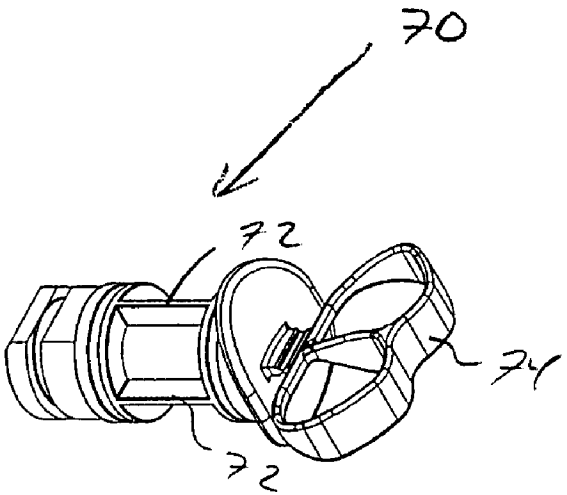

FIG. 4 illustrates a locking member 70 for the temporary door latch 40, in accordance with another embodiment of the present invention. As shown in FIG. 4, the locking member 70 is substantially similar to the locking member 40 shown in FIGS. 2 and 3, yet instead of the radially extending ribs 61, the locking member 70 includes a plurality of longitudinally extending ribs 72. The ribs 72 perform substantially the same task as do the ribs 61 in that they also provide sliding contact with the inner surface of the face bore 28, while providing for similar reductions in the friction caused by such sliding contact. FIG. 5 illustrates a cross-sectional view of the locking member 70, including the actuation portion 74 and the inscribed threads 76.

Figure 7:
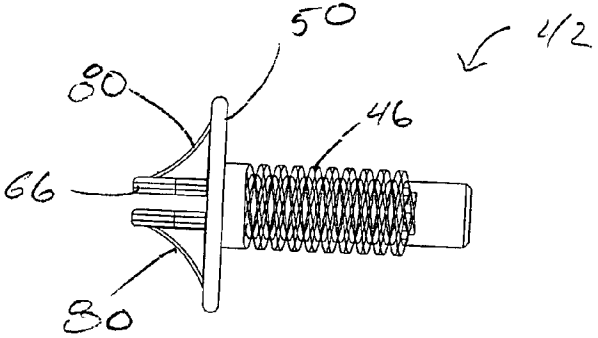
FIG. 7 illustrates a partial cross-sectional side view of the threaded engagement member shown in FIG. 6.
Figure 8:
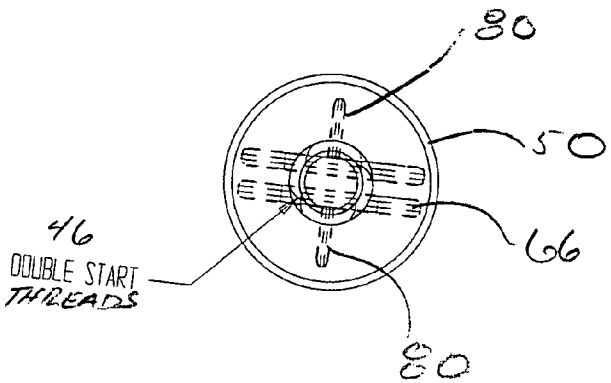
FIG. 8 illustrates a partial cross-sectional bottom view of the threaded engagement member shown in FIG. 6.
Figure 6:
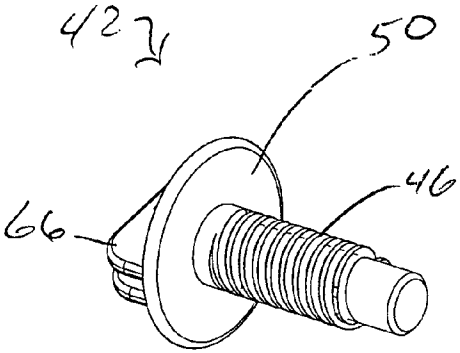
FIG. 6 illustrates a perspective view of the threaded engagement member according to one embodiment of the present invention.

FIGS. 6–8 illustrate differing views of the threaded engagement member 42. As shown in FIGS. 6–8 in combination, the turning vane 66 of the engagement member 42 includes a pair of substantially parallel protrusions which are spaced apart by a given amount so as to accept a turning tool, such as but not limited to a screwdriver, to assist in the tightening and loosening of engagement member 42. Moreover, the engagement member 42 further includes a pair of arcuate wings 80 formed adjacent to, and connecting with, the turning vane 66. The wings 80 help to assist an operator should the engagement member 42 be threadedly engaged or disengaged by hand.

Figure 9:
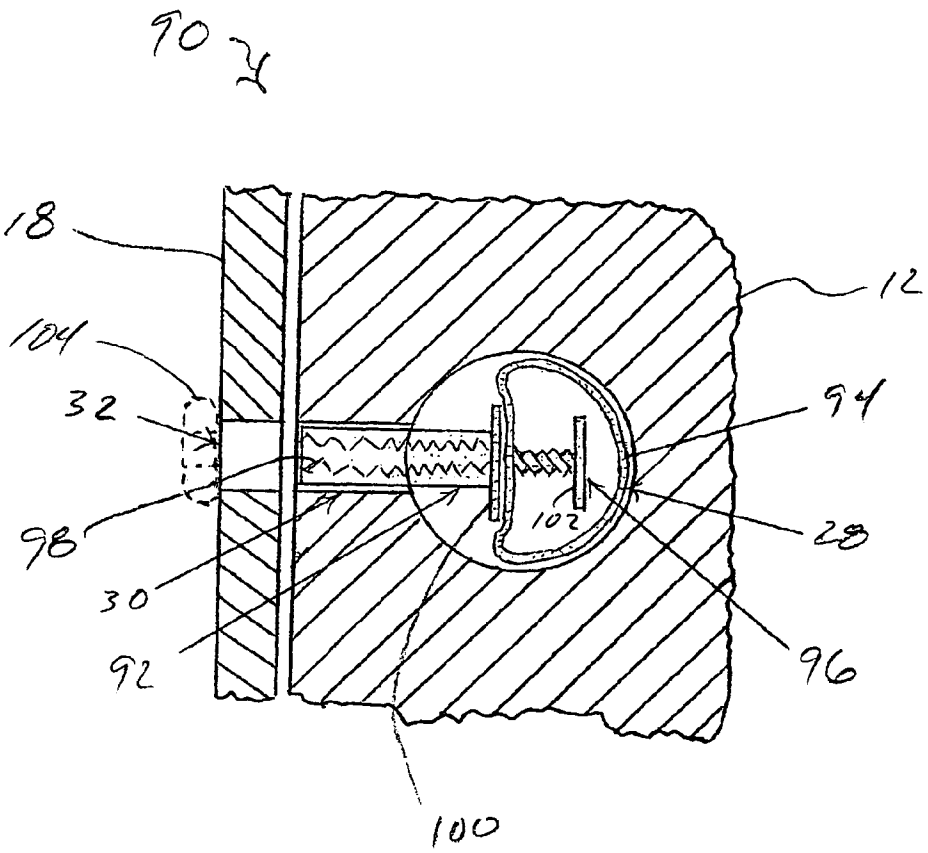
FIG. 9 illustrates a partial cross-sectional side view of a temporary door latch, in accordance with another embodiment of the present invention.

Turning to FIG. 9, a partial cross-sectional side view of a temporary door latch 90 is shown, in accordance with another embodiment of the present invention. The temporary door latch 90 includes a locking member 92 and an actuation member 94, and performs substantially the same task in substantially the same manner as does the temporary door latch 40 discussed in connection with FIGS. 2 and 3. As shown in FIG. 9, however, the threaded engagement member 96 has been repositioned to extend into the inscribed threads 98 of the bolt portion of the locking member 92 via the face bore 28.

In operation, the engagement member 96 is initially disposed through the strike bore 32, thereby mating with the inscribed threads 98 and drawing the collar 100 against the inner periphery of the face bore 28. Once located at the work site, the engagement member 96 is removed to permit the initial installation of the pre-hung door assembly, as previously discussed. In contrast to the previously discussed embodiment, the engagement member 96 is repositioned through the face bore 28 to again engage the inscribed threads 98 in a different direction, as shown in FIG. 9.

It is therefore another important aspect of the present invention that by utilizing the configuration shown in FIG. 9, the present invention effectively saves the engagement member 96 so that it may be utilized again, if desired, in the future. Moreover, by threading the engagement member 96 through the face bore 28 and into the locking member 92, the extending flange 102 of the engagement member may provide an additional biasing surface which an operator may utilize to assist in moving the temporary door latch 90 in either a locking or unlocking direction.

In another embodiment of the present invention, it is contemplated that the engagement member 96 may initially extend through the locking member 92 via the face bore 28 and extend out of the edge bore 32. A nut 104 may then be employed to securely fix the door 12 to the strike jam 18 during transportation, or the like. Subsequent to delivery to the work site, the nut 104 may be removed and the engagement member 96 may be utilized as discussed previously.

Figure 10:
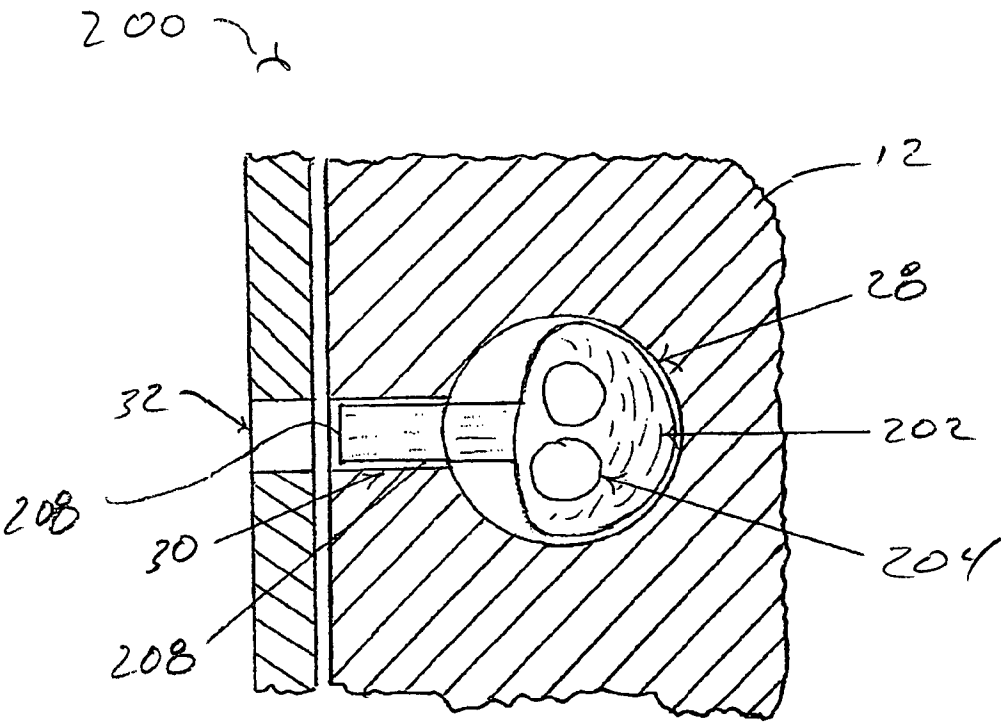
FIG. 10 illustrates a partial cross-sectional side view of a temporary door latch, in accordance with another embodiment of the present invention.

FIG. 10 illustrates a temporary door latch 200 in accordance with yet another embodiment of the present invention. The temporary door latch 200 operates in substantially the same manner as does the temporary door latch 40, however the nature of the actuation member 202 differs. As shown in FIG. 10, the actuation member 202 is formed from s a resilient, yet compressible material having one or more through holes 204 defined therein. When the distal end 206 of the locking member 208 is disposed within the edge bore 32, an unillustrated engaging member will again be utilized to secure the door 12 to the strike jam 18. However, when the unillustrated engagement member is removed from engagement with the locking member 208, an operator may then utilize the through holes 204 to shift the temporary door latch 200 in a unlocking direction, thus compressing the material of the actuation member 202.

It is therefore another important aspect of the present invention that by forming the actuation member 204 to be a substantially planar, compressible element, the actuation member 204 is thereby capable of substantially filling the area defined by the face bore 28. In doing so, the actuation member 204 effectively closes the area defined by the face bore 28 and thus, when the locking member 208 is moved to its locked position, the migration of heat, rain or other matter is effectively prevented.

It will be readily appreciated that the present invention contemplates forming the temporary door latch of the various embodiments discussed herein, from any known and suitable material. Preferably, the constituent elements of the temporary door latch embodiments described herein are formed from a plastic or ploymer material, which may be milled, injection molded or otherwise crafted without departing from the broader aspects of the present invention.

It will also be readily appreciated that the temporary door latch of the present invention is sized to permit use with doors, and their related face bores and edge bores, having standardized dimensions. Moreover, the present invention contemplates that the temporary door latch may be fashioned to any specific size or dimension without departing from the broader aspects of the present invention.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position;

a substantially oval shaped collar having an arcuate cross section adapted to extend in all radial directions beyond said diameter of said bolt portion such that said collar has a dimension larger than a diameter of said edge bore, said collar being disposed adjacent to said actuation member; and wherein said actuation member is adapted to be spaced from an inner periphery of said face bore and further adapted to extend into said face bore when said collar is substantially abutting said inner periphery.

2. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position, said bolt portion includes an arresting aperture formed therein, said arresting aperture being adapted to be substantially aligned with said lateral edge of said door when said bolt portion is in said latching position;

a collar extending outward from said bolt portion such that said collar is configured to have a dimension larger than a diameter of said edge bore, said collar being disposed adjacent to said actuation member; and wherein said actuation member adapted to be spaced from an inner periphery of said face bore and extend into said face bore when said collar is substantially abutting said inner periphery.

3. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position, said actuation member is connected to said bolt portion via a flexible neck portion, said actuation member selectively bends about said neck portion in a substantially perpendicular direction to a longitudinal axis of said bolt portion;

a collar extending outward from said bolt portion and being adapted such that said collar is adapted to have a dimension larger than a diameter of said edge bore, said collar being disposed adjacent to said actuation member; and wherein said actuation member is adapted to be spaced from an inner periphery of said face bore and extends into said face bore when said collar is substantially abutting said inner.

4. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position, said actuation member defining a substantially circular profile;

a collar extending outward from said bolt portion such that said collar is adapted to have a dimension larger than a diameter of said edge bore said collar being disposed adjacent to said actuation member; and wherein said actuation member is adapted to be spaced from an inner periphery of said face bore and extend into said face bore when said collar is substantially abutting said inner periphery.

5. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position, said actuation member is formed from a compressible material which is adapted to substantially fill said face bore when said bolt portion extends through said edge bore;

a collar extending outward from said bolt portion such that said collar is adapted to have a dimension larger than a diameter of said edge bore, said collar being disposed adjacent to said actuation member; and wherein said actuation member is adapted to be spaced from an inner periphery of said face bore and extend into said face bore when said collar is substantially abutting said inner periphery.

6. The temporary door latch according to claim 5, wherein: said actuation member includes an aperture formed in said compressible material.

7. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position;

a flexible neck portion connecting said actuation member to said bolt portion, wherein said neck portion selectively permits said actuation member to bend in a substantially perpendicular direction to a longitudinal axis of said bolt portion;

a collar extending out-ward from said bolt portion such that said collar is adapted to extend in all radial directions beyond a diameter of said bolt portion, said collar being disposed adjacent to said neck portion; and a threaded engagement member having threads defined along a longitudinally extending shank portion and a flange disposed adjacent one distal end of said shank portion, said flange adapted to have a diameter larger than a diameter of said strike bore; said bolt portion includes a longitudinally extending inner bore having matching threads inscribed thereon; and wherein when said threaded engagement member is inserted through said actuation member and into threaded engagement with said longitudinally extending inner bore, said flange and said collar are biased towards one another thus adapted to fix said door jam in relation to said door.

8. A temporary door latch adapted for use with a door having a face bore and an edge bore, said edge bore extending from said face bore to a lateral edge of said door and being disposed in substantial alignment with a strike bore of a door jam comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position, said actuation member defines a substantially circular profile and member is formed from a compressible material which is adapted to substantially fill said face bore when said bolt portion extends through said edge bore; and a flexible neck portion connecting said actuation member to said bolt portion, wherein said neck portion selectively permits said actuation member to bend in a substantially perpendicular direction to a longitudinal axis of said bolt portion.

9. A temporary door latch adapted for use with a door having a face bore and an edge bore, said edge bore extending from said face bore to a lateral edge of said door and being disposed in substantial alignment with a strike bore of a door jam, comprising:

a longitudinal bolt portion being dimensioned to extend through said edge bore and into said strike bore when said bolt portion is in a latching position;

an actuation member disposed adjacent one distal end of said bolt portion and being selectively operable to move said bolt portion between said latching position and a non-latching position;

a flexible neck portion connecting said actuation member to said bolt portion, wherein said neck portion selectively permits said actuation member to bend in a substantially perpendicular direction to a longitudinal axis of said bolt portion; and a substantially oval collar having an arcuate cross-section and extending outward from said bolt portion such that said collar is adapted to extend in all radial directions beyond a diameter of said bolt portion, said collar being disposed adjacent to said neck portion.

* * * * *